US005205016A

United States Patent [19]

Kulot et al.

[11] Patent Number: 5,205,016

[45] Date of Patent: Apr. 27, 1993

[54] DOOR HOLDING DEVICE

[75] Inventors: Richard Kulot, Remscheid; Heinz-Walter Heinemann, Wuppertal; Jürgen Brockhaus, Remscheid, all of Fed. Rep. of Germany

[73] Assignee: Ed. Scharwachter GmbH & Co. KG, Remscheid, Fed. Rep. of Germany

[21] Appl. No.: 895,191

[22] Filed: Jun. 5, 1992

Related U.S. Application Data

[63] Continuation of Ser. No. 706,555, May 28, 1991, abandoned, which is a continuation of Ser. No. 610,341, Nov. 5, 1990, abandoned, which is a continuation of Ser. No. 420,674, Oct. 10, 1989, abandoned, which is a continuation of Ser. No. 39,536, Apr. 16, 1987, abandoned.

[30] Foreign Application Priority Data

Sep. 6, 1986 [DE] Fed. Rep. of Germany ..... 3630463

[51] Int. Cl.[5] ..... E05D 11/08; E05C 17/04; E05C 17/12

[52] U.S. Cl. ..... 16/82; 16/381; 16/386; 16/DIG. 6; 16/342; 292/DIG. 73

[58] Field of Search ..... 16/82, 86 A, 86 C, 86 B, 16/86 R, 83, 341, 342, 344, 332, 335, 337, 352, 386, 389, 273, 274, 382, 388, 339, DIG. 10, DIG. 17, DIG. 6, 85, 27; 292/275, 268, DIG. 73

[56] References Cited

U.S. PATENT DOCUMENTS

| | | | |
|---|---|---|---|
| 290,464 | 12/1883 | Parnall | 16/388 |
| 1,429,416 | 9/1922 | Fade | 16/386 |
| 1,936,769 | 5/1932 | Olivet | 16/381 |
| 2,344,808 | 3/1943 | Duffield et al. | 403/146 |
| 2,527,933 | 10/1950 | Jakeway | 16/85 |
| 2,715,746 | 8/1955 | Travis | 16/85 |
| 2,767,422 | 10/1956 | Ulrich | 16/85 |
| 3,474,470 | 10/1969 | Watson | 16/337 |
| 4,011,628 | 3/1977 | Bengtsson | 16/339 |
| 4,879,785 | 11/1989 | Tolle et al. | 16/386 |

FOREIGN PATENT DOCUMENTS

| | | | |
|---|---|---|---|
| 1071506 | 12/1959 | Fed. Rep. of Germany | 16/82 |
| 2415887 | 9/1975 | Fed. Rep. of Germany | 16/86 R |

*Primary Examiner*—Robert L. Spruill
*Assistant Examiner*—Donald M. Gurley
*Attorney, Agent, or Firm*—Anderson Kill Olick & Oshinsky

[57] ABSTRACT

A door holding device for motor vehicle doors includes a door holding rod which is swivelably attached to a structural door component, a door or a door post. The door holding rod extends with its other end through a holder housing mounted on another structural component or the like. The door holding rod has along its length increased thickness portions which protrude outwardly transversely of the longitudinal direction of the door holding rod. The door holding rod is freely swivelably mounted on a carrier member by means of a clinch bolt or a screw bolt. A spring load is applied to the door holding rod in axial direction of the swivel bearing of the door holding rod. The clinch bolt or screw bolt is mounted secured against rotation in the opening of the carrier member. The clinch bolt or screw bolt additionally has a knurled profiling in engagement with the opening of the door holding rod.

14 Claims, 2 Drawing Sheets

DOOR HOLDING DEVICE

This is a continuation of application Ser. No. 07/706,555 filed May 28,1991, abandoned; which is a continuation of application Ser. No. 07/610,341 filed Nov. 5, 1990, abandoned; which is a continuation of application Ser. No. 07/420,674 filed Oct. 10, 1989, abandoned; which in turn is a continuation of application Ser. No. 07/039,536 filed Apr. 16, 1987, abandoned.

BACKGROUND OF THE INVENTION

1. Field of the Invention

The present invention relates to a door holding device, particularly for motor vehicle doors. The door holding device includes a door holding rod which is swivelably attached to a structural door component, a door or a door post. The door holding rod extends with its other end through a holder housing mounted on another structural door component or the like. The door holding rod has along its length increased diameter portions which protrude outwardly transversely of the longitudinal direction of the door holding rod. The door holding rod is freely swivelably mounted on a carrier member by means of a clinch bolt or a screw bolt. The carrier member is formed by a single shaped piece and is attached to one of the structural door components.

2. Description of the Prior Art

Door holding devices of the above-described type are known. In the known door holding devices, the carrier member supporting the swivel bearing of the door holding rod is formed by a blank of flat material which has been twisted by 90°. Thus, the carrier member is made of a single-piece material blank in a punching and shaping procedure. The carrier member has a stiffness which is sufficient for a secure support of the swivel bearing of the door holding rod.

However, the carrier member of the known door holding device has the disadvantage that for ensuring a sufficient stiffness a relatively thick initial material must be used. The natural stiffness of this initial material is additionally reduced because the necessary cut for punching out the blank leads to a disturbance of the existing pattern of the fibers of the material, so that an even greater thickness of the initial material must be used as would be required for the actually necessary stiffness. This leads to an undesirable increase of the manufacturing costs and to an also undesirable increase in the weight of the door holding device.

Although the carrier member of the swivel bearing for the door holding rod in the known door holding device is simple to manufacture, the carrier member has the further disadvantage that it provides only insufficient safety with respect to a rotation of the bearing pin for the door holding rod and that its fastening to the structural door component, the door or the door post is not absolutely reliable because it is secured only by surface pressure.

In devices for supporting door holding rods on the carrier members or support members, it is further known to avoid play between the bearing opening in the door holding rod and the bearing pin extending through the bearing hole by providing the bearing pin with a deformable surface profiling. Specifically, it has been proposed to equip the bearing pin with an axially directed circumferential milling. This milling deforms when the bearing pin is driven in and, thus, ensures a support of the door holding rod which is absolutely free of play. As a result, even after long term use, no rattling noises can be caused by sudden loads on the bearing by the passage through the holder housing of the increased thickness portions of the door holding rod. However, obtaining the play-free support of the door holding rod by means of an axially directed circumferential milling has not been found fully satisfactory because the parallel profilings of a circumferential milling can still lead to a sudden passage of the increased thickness portions of the door holding rod through the holder housing.

It is, therefore, the primary object of the present invention to improve a door holding device of the aforedescribed type, so that the manufacturing costs and the weight of the door holding device are reduced. The forces resulting from the manner of operation of the door holding device are to be absolutely securely supported. In addition, a completely noise-free operation of the device is desired even during long-term operation. Finally, an optimum shape of the structural components is to be achieved.

SUMMARY OF THE INVENTION

In accordance with the present invention, a spring load is applied to the door holding rod in axial direction of the swivel bearing of the door holding rod, wherein the spring rests against the head of the clinch bolt or screw bolt. The clinch bolt or screw bolt is mounted secured against rotation in the opening of the carrier member. The clinch bolt or screw bolt additionally has a knurled profiling in engagement with the opening of the door holder rod, the knurled profiling ensuring an engagement which is free of play and secured against sudden rotation and also providing a bed for a supply of lubricant.

In accordance with another feature of the present invention, the carrier member is made from a portion of a round material as the initial material. The two ends of this round blank are then pressed or squeezed into two end faces extending perpendicularly to each other. A door closing device including such a carrier member has a very low weight and a sufficient stiffness, and can be manufactured in a very simple manner. In addition, it is ensured that even after long term use no noise is generated within the the support of the door holding rod. Moreover, the entire device can be assembled in a very simple manner.

In accordance with another embodiment of the invention, the spring resting against the head of the clinch bolt or screw bolt is a spring washer or plate spring. The clinch bolt or screw bolt forms over a part of its length the swivel bearing of the door holding rod. In order to ensure that the clinch bolt or screw bolt does not rotate relative to the carrier member, the opening of the carrier member has a cross-sectional shape which coincides with the cross-sectional shape of the corresponding portion of the clinch bolt or screw bolt. This cross-sectional shape is different from the circular shape and may particularly be polygonal or oval.

In accordance with another feature of the present invention, the shaft of the clinch bolt or screw bolt may over the portion of its length which supports the door holding rod have a greater diameter than in the portion of its length where it is engaged by the carrier member.

In accordance with yet another advantageous feature of the invention, the opening of the carrier which engages the aforementioned shaft portion of the clinch bolt or screw bolt may have a conical shape at least over a portion of its depth, so that the thickness of the bolt shaft increases during riveting, thereby resulting in a further securing of the bearing.

For securely fastening the carrier member to the respective structural door component, it is further provided that the surface of the carrier member resting against the structural door component has anchoring means which projects above the plane of the surface, such as, claws or similar profilings, so that when the carrier member is mounted a mechanical connection between the carrier member surface and the corresponding structural door component is automatically effected.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE PRESENT INVENTION

Figure 1:
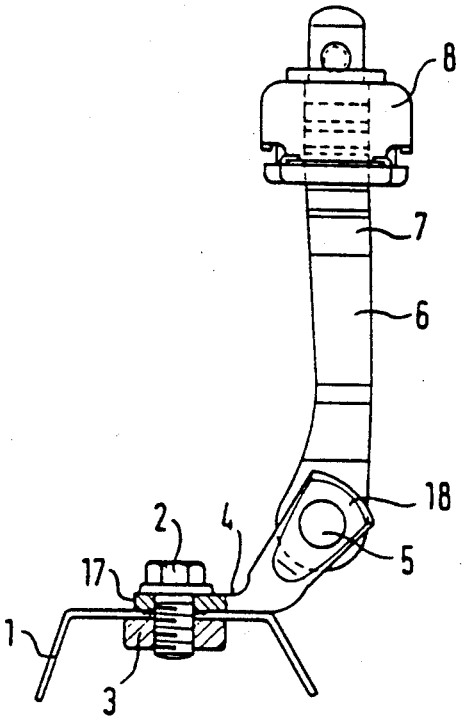
FIG. 1 is a side elevational view of a door holding device according to the present invention.
Figure 2:
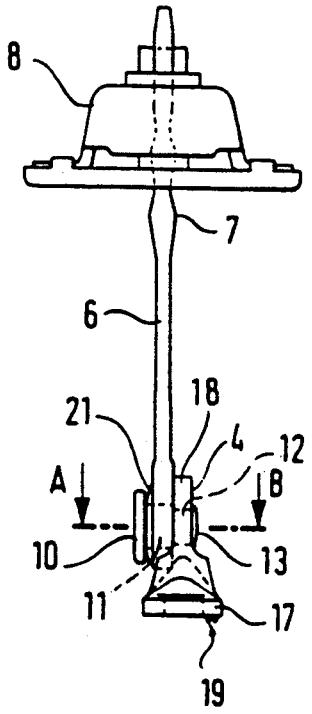
FIG. 2 is a front elevational view of the door holding device of FIG. 1.

As illustrated in FIG. 1, a cantilevering carrier member 4 for the swivel bearing 5 of a door holding rod 6 is attached to a structural door component 1 by means of a screw bolt 2 and a nut 3. The other end of door holding rod 6 extends through a holder housing 8 which is part of a second structural door component, not shown. The door holding rod 6 has increased thickness portions 7.

The swivel bearing 5 may be formed by a clinch bolt or a screw bolt. In the illustrated embodiment, the swivel bearing 5 is a clinch bolt 9 which includes a head 10, a first shaft portion 11, a second shaft portion 12 and a clinched part 13.

Figure 3:
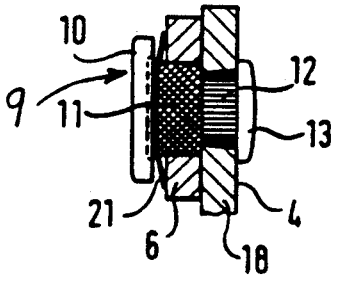
FIG. 3 is a partial sectional view, on a larger scale, taken along sectional line AB of FIG. 2.

As particularly illustrated in FIG. 3, the two shaft portions 11 and 12 of the clinch bolt 9 have different diameters. The door holding rod 6 is mounted on the shaft portion 11 having the greater diameter. The periphery of the shaft portion 11 of clinch bolt 9 has a knurled profiling, i.e., a deformable criss-cross surface profiling which permits the inclusion of a supply of lubricant and prevents the formation of chatter marks in the opening of the door holding rod. Also, this surface profiling ensures that the door holding device operates permanently without play and without noise.

The shaft portion 12 of clinch bolt 9 engaged by the opening 16 of carrier member 4 has an axially directed circumferential milling. In addition, along its length engaged by the opening of the carrier member 4, the clinch bolt 9 has a cross-sectional shape which deviates from the circular shape. The opening of the carrier member 4 has a cross-sectional shape 16 which corresponds to that of the just described shaft portion.

Carrier member 4 is manufactured from a portion of round material. The two end areas of the carrier member 4 define end faces 17 and 18 which extend perpendicularly to each other. The end areas of the carrier member 4 are formed by pressing or squeezing the material.

Figure 4:
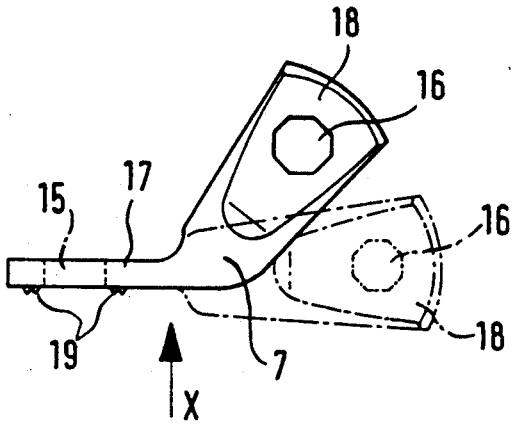
FIG. 4 is an enlarged view of a carrier member forming part of the door holding device shown in FIG. 1; another possible shape of the carrier member is illustrated in broken lines.
Figure 5:
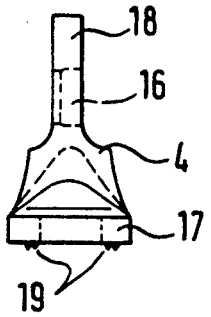
FIG. 5 is a front view of the carrier member shown in FIG. 4.
Figure 6:
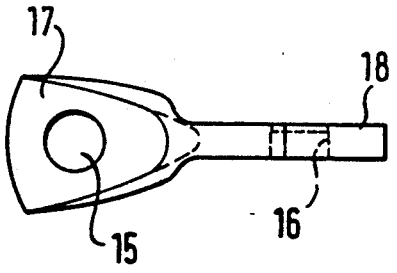
FIG. 6 is a top view of the carrier member shown in FIG. 4.
Figure 7:
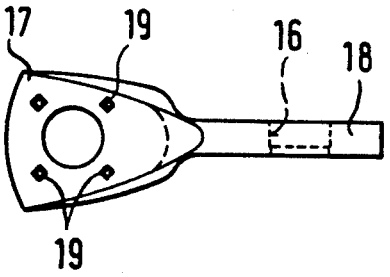
FIG. 7 is a bottom view of the carrier member shown in FIG. 4.

As can be seen from FIGS. 4, 5 and 7, the end face 17 may be provided with indentations or projections which form claws 19. FIG. 4 further shows that the overall shape of the carrier member 4 may be straight or angular. The angle of the carrier member 4 may vary within the range of from 0° to 90°.

Perpendicularly to the swivel bearing of the door holding rod 6 by means of the clinch bolt 9, a spring load is applied to the door holding rod 6. As illustrated in FIG. 3, the spring load may be applied by a spring washer 21 placed between the head 10 of clinch bolt 9 and the door holding rod 6.

While the specific embodiment of the invention has been shown and described in detail to illustrate the application of the inventive principles, it will be understood that the invention may be embodied otherwise without departing from such principles.

We claim:

1. A door holding device for motor vehicle doors, comprising a door holding rod having first and second ends, a carrier member having a cantilevered portion attached to a structural door component, the first end of the door holding rod freely swivelably connected to the cantilevered portion of the carrier member, the second end of the door holding rod extending through a holder housing mounted on another structural door component, door or door post, the door holding rod having along its length increased thickness portions protruding outwardly transversely of the longitudinal direction of the door holding rod near the second end of the door holding rod for cooperating with said holder housing to hold a door, the door holding rod and the carrier member defining openings, a bolt extending through the opening of the door holding rod and of the carrier member, so that the door holding rod is freely swivelable relative to the bolt, means mounting the carrier member non-rotatably relative to the bolt, the carrier member formed of a single shaped piece, the bolt having a head at one end and means at the other end for retaining the bolt in said openings, a spring mounted between the head of the bolt and the door holding rod, the bolt having a shaft portion, the shaft portion of the bolt defining a deformable criss-cross knurled surface profiling on the length of the bolt extending through the opening of the door holding rod, wherein the criss-cross knurled surface profiling ensures a play-free mounting of the bolt in the opening of the door holding rod.

2. The door holding device according to claim 1, wherein the bolt is a clinch bolt.

3. The door holding device according to claim 1, wherein the spring mounted between the head of the bolt and the door holding rod is a spring washer.

4. The door holding device according to claim 1, wherein the non-rotatable mounting means includes the bolt over a portion of its length formed so that it is non-rotatably mounted in the opening of the carrier member.

5. The door holding device according to claim 1, wherein the non-rotatable mounting means includes the opening in the carrier member and the shaft portion of the bolt extending through the opening in the carrier member have a coinciding cross-sectional shape, the cross-sectional shape differing from a circular shape.

6. The door holding device according to claim 5, wherein the cross-sectional shape is polygonal.

7. The door holding device according to claim 5, wherein the cross-sectional shape is oval.

8. The door holding device according to claim 1, wherein the shaft portion of the bolt has varying diameters along its length.

9. The door holding device according to claim 8, wherein the diameter of the shaft portion extending through the opening of the door holding rod is greater than the diameter of the shaft portion extending through the carrier member.

10. The door holding device according to claim 1, wherein the opening in the carrier member is conical at least over a portion of the depth of the opening.

11. The door holding device according to claim 1, wherein the opening in the carrier member has a cross-sectional shape which deviates from the circular shape over at least a portion of the depth of the opening.

12. The door holding device according to claim 1, wherein the carrier member is formed from a round material section and has first and second end faces extending perpendicularly relative to each other, the first end face including the opening for receiving the bolt, and the second end face defining an opening for receiving a fastening bolt for attaching the carrier member to a structural door component.

13. The door holding device according to claim 12, comprising mechanically acting securing means on a surface of the second end face facing the structural door component.

14. The door holding device according to claim 13, wherein the securing means are claws.

* * * * *